US007737319B2

(12) United States Patent
Matthews

(10) Patent No.: US 7,737,319 B2
(45) Date of Patent: Jun. 15, 2010

(54) TREATING RADIOACTIVE MATERIALS

(75) Inventor: Jack W. Matthews, Lone Tree, CO (US)

(73) Assignee: Llyon Technologies, LLC, Lone Tree, CO (US)

( * ) Notice: Subject to any disclaimer, the term of this patent is extended or adjusted under 35 U.S.C. 154(b) by 850 days.

(21) Appl. No.: 11/413,920

(22) Filed: Apr. 28, 2006

(65) Prior Publication Data

US 2006/0264687 A1 Nov. 23, 2006

Related U.S. Application Data

(60) Provisional application No. 60/676,062, filed on Apr. 29, 2005.

(51) Int. Cl.
*G21F 9/00* (2006.01)
*G21F 9/16* (2006.01)
*G21F 1/00* (2006.01)

(52) U.S. Cl. ..... 588/1; 588/2; 588/16; 588/901

(58) Field of Classification Search ..... None
See application file for complete search history.

(56) References Cited

U.S. PATENT DOCUMENTS

| | | | | |
|---|---|---|---|---|
| 5,063,862 | A | 11/1991 | Saly | |
| 5,143,654 | A | 9/1992 | Kikuchi et al. | |
| 5,262,024 | A * | 11/1993 | Lomasney et al. | 204/157.43 |
| 5,645,518 | A * | 7/1997 | Wagh et al. | 588/318 |
| 5,732,362 | A * | 3/1998 | Izumida et al. | 588/2 |
| 5,830,815 | A * | 11/1998 | Wagh et al. | 501/155 |
| 6,153,809 | A * | 11/2000 | Singh et al. | 588/255 |
| 6,419,738 | B1 | 7/2002 | Classen et al. | |
| 6,641,661 | B1 | 11/2003 | Jardine et al. | |
| 2006/0247484 | A1 | 11/2006 | Matthews | |
| 2007/0219404 | A1 | 9/2007 | Matthews | |

FOREIGN PATENT DOCUMENTS

| | | |
|---|---|---|
| CN | 1121494 | 5/1996 |
| GB | 2445420 | 9/2008 |
| WO | WO-0248067 | 6/2002 |
| WO | WO 2007/052919 | 5/2007 |
| WO | WO 2007/070628 | 6/2007 |

OTHER PUBLICATIONS

"salt." Merriam-Webster's Collegiate Dictionary. 10th ed. 1998.*

"U.S. Appl. No. 11/413,985 Office Action", (Jul. 19, 2007), 9.

Loedige.De, "lodige Company History", http://www.loedige.de/en/index.php?a=3, printed Jul. 16, 2007.

"U.S. Appl. No. 11/413,985 Notice of Allowability", (Mar. 14, 2008), 5 pgs.

"U.S. Appl. No. 11/413,985 Supplemental Notice of Allowability", 4 pgs.

"Cement", *Wikipedia, the free encyclopedia*, http://en.wikipedia.org/wiki/Cement, (Sep. 18, 2008), 6 pgs.

"Fundamentals of the management of radioactive waste", *Health and Safety Executive, the Environment Agency and the Scottish Environment Protection Agency*, (Dec. 2007) 20 pgs.

"Radioactive Waste", *Wikipedia, the free encyclopedia*, http://en.wikipedia.org/wiki/Radioactive_waste, (Sep. 15, 2008), 12 pgs.

"The management of higher activity radioactive waste on nuclear licensed sites", *Heath and Safety Executive, the Environment Agency, and the Scottish Environment Protection Agency*, (Dec. 2007), 18 pgs.

CL:AIRE, "Stabilisation/Solidification Treatment and Remediation: Part 1: Summary of the State of Practice Reports I-IV", *technical bulletin* (TB9), CL:AIRE {Contaminated Land: Applications in Real Environments), www.claire.co.uk, (Jun. 2004), 4 pages.

Dai, et al., "Crystal Structur of Hillebrandite: A Natural Analogue of Calcium Silicate Hydrate (CSH) Phases in Portland Cement", *American Mineralogist*, vol. 80, (1995), pp. 841-844.

Hans-Jurgen Butt, et al., "Physics and Chemistry of Interfaces", ISBN: 3-527-40413-9, *Wiley-VCH Verlag GmbH& Co. KGaA, Weinheim*, www.wiley-vch.de, (2003), pp. 61-68.

Hyatt, et al., "Zeolite-Salt Occlusion: A Potential Route for the Immobilisation of Iodine-129?", (2004), 6 pgs.

Ramachandran, V. S., et al., "Handbook of Analytical Techniques in Concrete Science and Technology", *Standard Publishers Distributor*, 1705-B, Nai Sarak, P.O. Box No. 1066, Delhi (India), ISBN: 81-8014-087-3, email: stpub@bsnl.com, website: www.standardpublishers.com, (2005), pp. 8-10, 17-18, 275-333,738-799.

Sharp, J. H., et al., "Cementitious Systems for Encapsulation of Intermediate Level Waste", *Proceedings of ICEM '03, The 9th International Conference on Radioactive Wast Management and Environmental Remediation*, Examination School, Oxford, England, (Sep. 21-25, 2003), 10 pgs.

Taylor, Peter , "A Review of Methods for Immobilizing Iodine-129 Arising From A Nuclear Fuel Recycle Plant, With Emphasis On Waste-Form Chemistry", *Atomic Energy of Canada Limited, Whiteshell Nuclear Research Establishment Pinawa*, Manitoba ROE 1LO, AECL-10163, (1990), 48 pgs.

"U.S. Appl. No. 11/801,910 Non-Final Office Action", mailed Sep. 22, 2009, 1-12 pgs.

* cited by examiner

*Primary Examiner*—Melvin C Mayes
*Assistant Examiner*—Sheng Han
(74) *Attorney, Agent, or Firm*—Blakely Sokoloff Taylor & Zafman, LLP

(57) ABSTRACT

Methods of treating radioactive materials are disclosed. In one aspect, a method may include mixing a radioactive isotope diluted in a filler material with a radioactive material treatment composition to form a resulting material. The radioactive material treatment composition may include mostly salt, and from 0.5 to 15 wt % sorbent. The method may further include mixing the resulting material with one or more inorganic binding agents. Other methods of treating radioactive materials are also disclosed, as well as compositions for treating radioactive materials.

16 Claims, 3 Drawing Sheets

TREATING RADIOACTIVE MATERIALS

RELATED APPLICATIONS

The present application claims priority from and fully incorporates herein, U.S. Provisional Patent Application No. 60/676,062 entitled "TREATING MATERIALS AND HAZARDOUS MATERIALS", filed on Apr. 29, 2005. The U.S. Provisional Patent Application No. 60/676,062 is incorporated herein by reference.

BACKGROUND

1. Field

Embodiments of the invention pertain to methods and compositions for treating hazardous materials. In particular, embodiments of the invention pertain to methods and compositions for treating radioactive materials.

2. Background Information

Radioactive isotope laden waste has been generated from the use of nuclear fuel, from the medical industries, and from weapons manufacture. It is often desirable to treat the radioactive isotope laden waste and contain the radioactive isotopes prior to long-term storage.

One approach that has been used to treat certain radioactive materials, such as, for example, cesium from spent fuel rods, includes adding the radioactive materials to borosilicate glass and melting the glass. However, this approach may offer a number of potential disadvantages.

One potential disadvantage is the generally high capital investment cost to build the glass plants. Another potential disadvantage is the high operational costs due to such factors as energy consumption and the high replacement cost of the refractory blocks of the glass plant.

Thus there is a general need in the art for new and useful approaches for treating radioactive isotope laden wastes.

BRIEF DESCRIPTION OF THE SEVERAL VIEWS OF THE DRAWINGS

The invention may best be understood by referring to the following description and accompanying drawings that are used to illustrate embodiments of the invention. In the drawings.

DETAILED DESCRIPTION

Embodiments of the invention pertain to methods of treating radioactive materials. Other embodiments of the invention pertain to compositions to treat the radioactive materials. Further embodiments of the invention pertain to methods of making the compositions or methods of using the compositions.

In the following description, numerous specific details are set forth. However, it is understood that embodiments of the invention may be practiced without these specific details. In other instances, well-known structures and techniques have not been shown in detail in order not to obscure the understanding of this description.

I. EXAMPLE RADIOACTIVE MATERIAL CONTAINMENT STRUCTURE HAVING MULTIPLE DIFFERENT MECHANISMS FOR CONTAINMENT

Radioactive isotopes, such as, for example, cesium, sodium, strontium, plutonium, uranium, actinides, and other radioactive isotopes, and combinations thereof, may be separated from spent fuel rods, medical wastes, or other nuclear wastes, or otherwise provided. The scope of the invention is not limited to how the radioactive isotopes are obtained. The radioactive isotopes may be diluted in a filler material and then treated and contained within a multi-layered containment structure.

Figure 1:
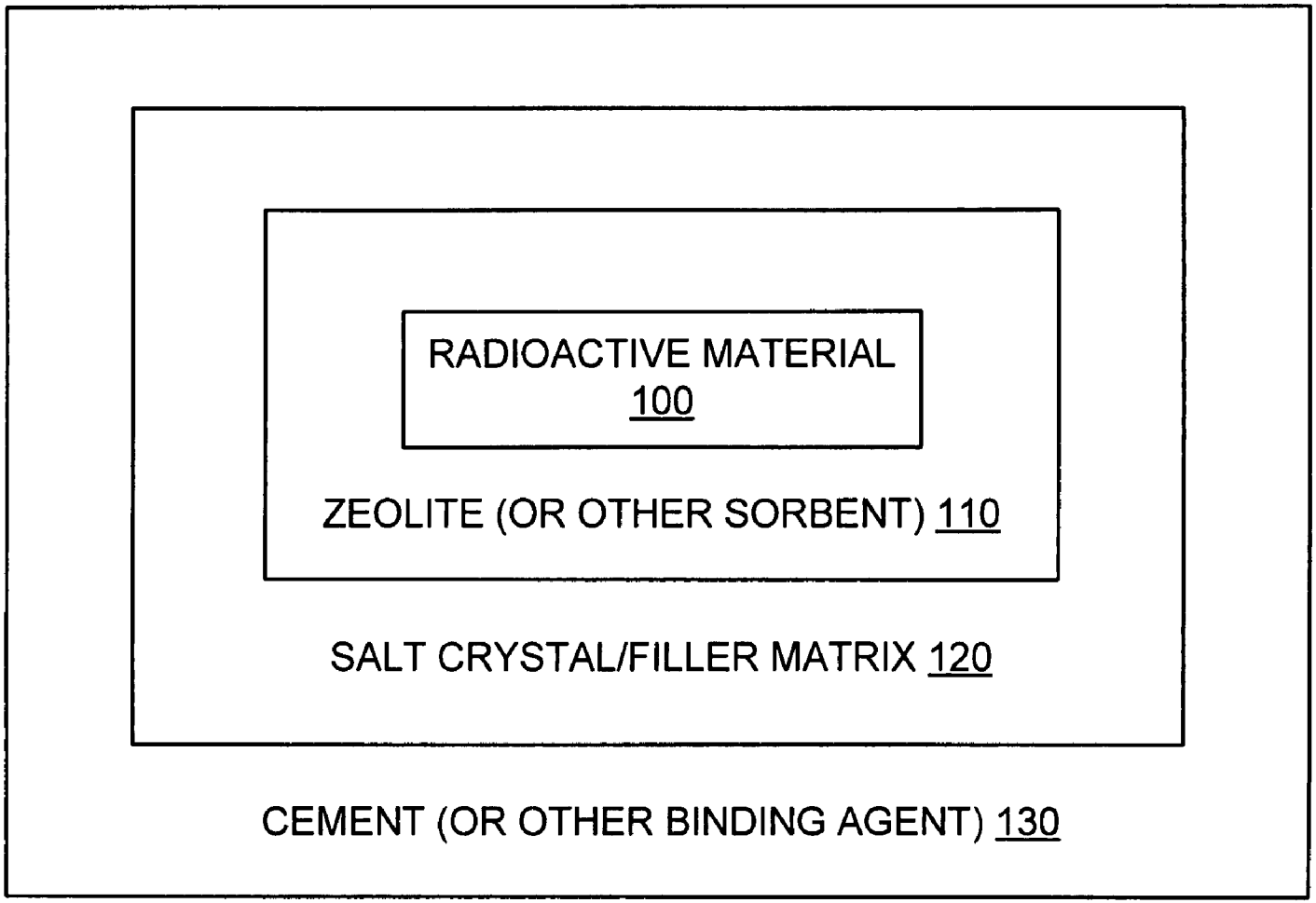
FIG. 1 conceptually illustrates a treated radioactive material within a containment structure, according to one or more embodiments of the invention.

FIG. 1 conceptually illustrates a treated radioactive material 100, such as, for example, radioactive isotopes, within a containment structure 110, 120, 130, according to one or more embodiments of the invention. The containment structure includes a zeolite (or other sorbent) 110, a salt crystal/filler matrix 120, and a cement (or other inorganic binding agent or hardening material) 130. The filler material may be used to dilute the radioactive isotopes prior to treatment, such as, for example, to a dilution level that meets criticality standards. A potential advantage of the multi-layered containment structure is that radioactive isotope may be sealed in the zeolite or other sorbent and contained by multiple different layers and mechanisms of containment.

The zeolite or sorbent may provide a first mechanism and material of containment for the radioactive isotopes. The radioactive isotopes may be selectively drawn into or sorbed and chemically held or retained in cavities or pores of the internal structure of the zeolite or other sorbent. Chemical bonds or interactions may be used to hold the radioactive isotopes within the zeolites or other sorbents. By way of example, heavy metal cations and other ions may be coordinated within the zeolite by an ion exchange process and held by ionic chemical forces.

The salt crystal/filler matrix may provide a second layered mechanism and material of containment of the radioactive isotopes. The zeolite or other sorbent may be coated or surrounded, at least partially, by a portion of the salt crystal/filler matrix. In the matrix, the crystals may be bonded with surfaces of the filler. The salt crystals may also be formed in and may tend to close off or block the pores or other openings of the zeolite or other sorbent. The salt crystal/filler within the pores may tend to be relatively dense and impenetrable by the radioactive isotopes and may tend to close or seal the radioactive isotopes therein. In some cases remaining portions of the radioactive isotopes may be incorporated directly into the salt crystals, which may further help to immobilize and contain the radioactive isotopes or hazardous material.

The cement or other inorganic binding agent or hardening material may provide a third outer mechanism and material layer of containment of the radioactive isotopes. The cement may tend to coat, surround, and/or encapsulate the crystal/filler matrix. The cement may tend to fill in gaps in the crystal/filler matrix, and may tend to be formed in and close off remaining pores or other openings of the zeolite or other sorbent. This may further tend to close and seal the radioactive isotopes within the cement. In some cases remaining portions of the radioactive isotopes may be incorporated directly into the hardened cement by cementitious reactions, which may further help to immobilize and contain the radioactive isotopes or hazardous material.

The use of a layered containment structure including multiple different material layers and mechanisms of containment may help to immobilize and contain the radioactive isotopes. This may help to reduce leaching, migration, and other movement of the radioactive isotopes.

A conceptual illustration of the sequential or layered containment process and result for a single sorbent particle have been used for purposes of illustration. It is to be appreciated that when dealing with real materials and processes, perfect layering may not necessarily always be achieved. In addition, such layering may be formed around clumps or other groups of particles, rather than a single sorbent particle.

II. EXAMPLE METHOD FOR TREATING RADIOACTIVE MATERIALS

Figure 2:
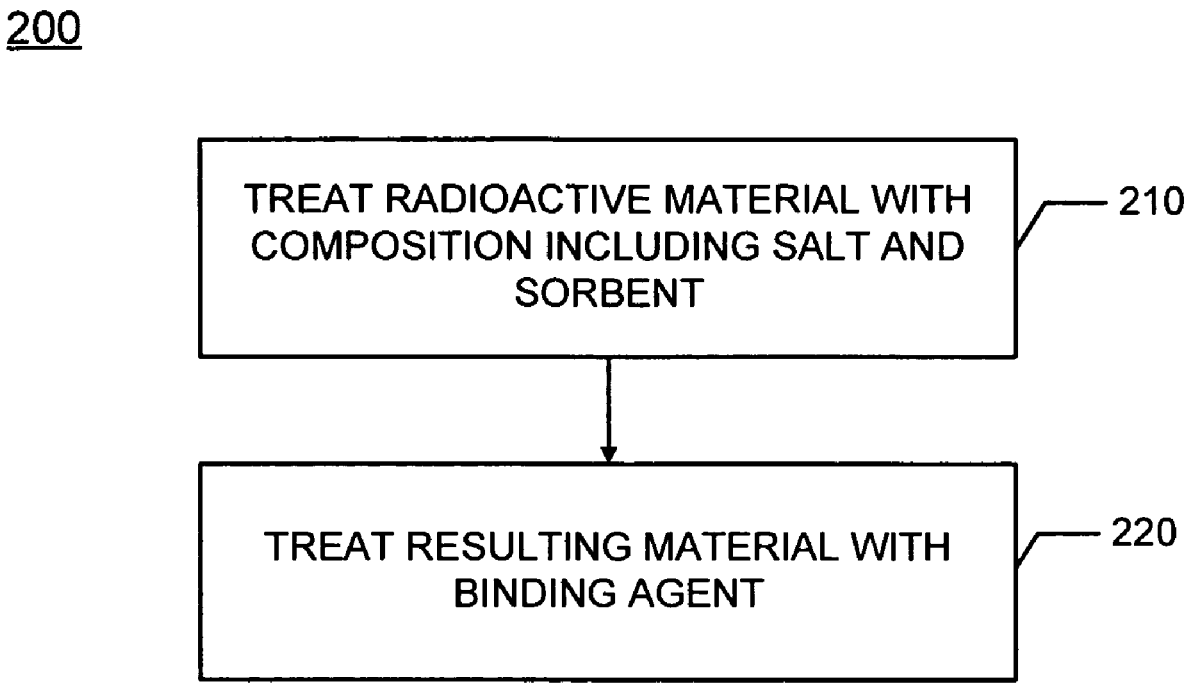
FIG. 2 is a block diagram of a method of treating radioactive materials, according to one or more embodiments of the invention.

FIG. 2 is a block diagram of a method 200 of treating radioactive materials, according to one or more embodiments of the invention. The method includes treating the radioactive material with a composition including a sorbent and a salt, at block 210. The sorbent may sorb at least a portion of the radioactive material, and the salt may crystallize around the sorbent to help encapsulate the radioactive material within the sorbent and/or the containment structure.

Then, the resulting treated radioactive material may be treated with an inorganic binding agent or hardening agent, such as, for example, cement, lime, tricalcium silicate, or other cementitious material, or combination thereof, at block 220. The hardening material or binding material may harden around the sorbent and salt crystals and further help to encapsulate or seal the radioactive material within the sorbent and/or the containment structure.

III. ANOTHER EXAMPLE METHOD FOR TREATING RADIOACTIVE MATERIALS

Figure 3:
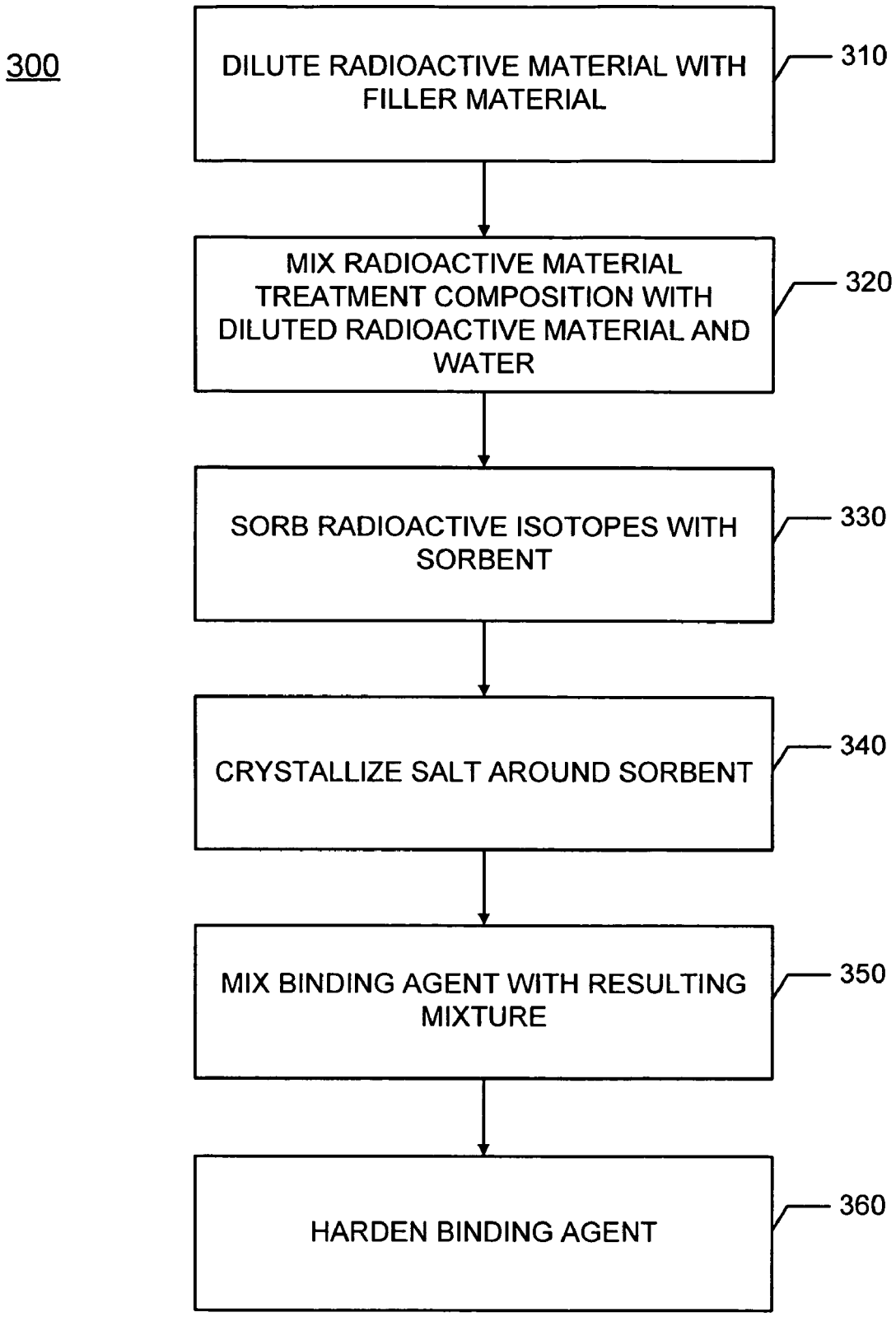
FIG. 3 is a block diagram of another method of treating radioactive materials, according to one or more embodiments of the invention.

FIG. 3 is a block diagram of another method 300 of treating radioactive materials, according to one or more embodiments of the invention. Examples of suitable radioactive materials that may be treated include, but are not limited to, radioactive isotopes diluted in a filler material to meet criticality objectives.

A. Dilution of Radioactive Material in Filler Material

In one or more embodiments of the invention, prior to treatment with a radioactive material treatment composition as disclosed elsewhere herein, the radioactive materials may optionally be diluted with a filler material, at block 310. Radioactive isotopes, such as, for example, those of cesium and uranium, are often stored for prolonged periods of time at relatively low concentrations in order to reduce the likelihood that the isotopes can partake in a nuclear reaction. This is sometimes known in the nuclear arts as "criticality".

A method, according to one or more embodiments of the invention, may include dilution of one or more types of radioactive isotopes or materials with a filler material by mixing or otherwise combining the isotopes or radioactive material with the filler material. In one or more embodiments, the isotopes may be diluted to a concentration, such as, for example, in parts-per-million, that complies with criticality standards, such as requirements, regulations, guidelines, and/or preferences, although the scope of the invention is not limited to any known dilution.

Examples of suitable filler materials that may be used to dilute radioactive isotopes, according to various embodiments of the invention, include, but are not limited to, silica flour, microcrystalline silica particles, aluminum oxide particles, calcined alumino-silicate or particles, such as, for example, calcined bentonite and kaolin particles, fine sand, flint powder, and combinations thereof. Other examples of suitable filler materials that may be used to dilute radioactive isotopes including cesium may include a powdered conventional lime glass composition. By way of example, the powdered lime glass composition may include varying proportions of powdered silicon dioxide ($SiO_2$) e.g., fused silica, powdered aluminum oxide ($Al_2O_3$), and powdered calcium oxide (CaO), which may be mixed together. Another suitable filler material may include a borosilicate glass, such as, for example, those used to fabricate pyrex. Such a filler material may offer a potential advantage of better thermal shock resistance than lime glass. Still other suitable filler materials include, but are not limited to, fly ash, such as, for example, Type C and/or Type F fly ash. In one or more embodiments of the invention, a calcined residual of the spent fuel rods in a conventional spent fuel rod process may also potentially be used as a base material for diluting the cesium or other radioactive isotopes. Other filler materials are also suitable. Various combinations of filler materials are also suitable.

One particular example of a filler may include 4 (v/v) % microcrystalline silicon, 23 (v/v) % powdered flint, 22 (v/v) % fine sand, 11 (v/v) % course calcined clay having average diameter of 3-4 millimeters, and 40 (v/v) % calcined bentonite. However, the scope of the invention is not limited to this particular filler material.

In one or more embodiments of the invention, the particle sizes of the filler material may optionally be adjusted, such as, for example, by grinding, or sieving, or mixing multiple particle sizes together, to adjust the packing density of the particles. In one particular aspect, the particle sizes may be adjusted to achieve dense close-order packing by approaches that are known in the arts. Such adjustment of the density may potentially allow additional control over isotope concentration and criticality.

In one or more embodiments of the invention, the particle sizes of the filler may optionally be adjusted or otherwise controlled so that the filler may have a substantially predetermined fineness modulus, although this is not required. The fineness modulus is an empirical factor that may be determined by adding together percentages of a filler sample retained on each of a specified series of sieves, and dividing the sum by 100. By way of example, in one or more embodiments of the invention, the filler material may have a fineness modulus in the range of from about 3.3 to 3.7, although the scope of the invention is not limited in this respect.

Radioactive isotopes may potentially be presented for treatment in a medium including particles or other structures having holes, such as, for example, cavities, pores, or capillaries, of various different sizes and shapes. In such cases, the isotopes may be included within the holes of different sizes and shapes. A filler having particles of different sizes, and in particular a filler having a fineness modulus in the aforementioned range, may be well suited for plugging the holes, which may help to seal the isotopes in the holes. This may help to reduce leaching, isotope migration, or other movement of the isotopes.

In one or more embodiments of the invention, superfine particles of the filler material, or a smallest fraction or portion of the filler material, may optionally be removed, such as, for example, by retaining the larger particles over a superfine mesh. For example, superfine particles passing through a 50 mesh, or 100 mesh, or smaller mesh may optionally be discarded, although this is not required. This may help to reduce the superfine particles from clogging or otherwise interfering with the openings and cavities of the zeolites.

In one or more embodiments of the invention, an isotope may optionally be mixed or otherwise combined with only a portion of the particles, such as, for example, a particular type of particle, or a particular size of particle (e.g., sieve fraction), although this is not required. For example, an isotope may first be mixed with particles of a first type of material, and then particles of a second different type of material may be mixed in. As another example, an isotope may first be mixed with large particles, and then small particles may be mixed in. By way of example, this may also achieve more sophisticated control over isotope criticality.

According to one or more embodiments of the invention, a filler material may optionally include particles of two or more different materials that may be capable of undergoing interfacial reactions with one another, although this is not required. By way of example, in one or more embodiments of the invention, the particles of the different materials may be capable of undergoing cementitious or other binding reactions with one another. As one particular example, a filler material may include particles of silica and alumina, which may undergo interfacial cementitious or other interfacial binding reactions with one another. Other materials capable of participating in such cementitous or other interfacial binding are also suitable, such as, for example, magnesium oxide, lime, lime glass, pozzolanic materials, alumino-silicate materials, and the like. These binding reactions may help to bind the particles together, add mechanical strength and stability to the treated materials disclosed herein, and may further seal radioactive materials within the treated materials. Similarly, in one or more embodiments of the invention, the particles of the two or more different materials may be included in the filler in chemically stable proportions to promote stability in mechanical strength and radioactive material containment properties.

In one or more embodiments of the invention, the isotopes and filler material to which the isotopes are to be mixed may be introduced into and mixed in a mixer. Examples of suitable mixers include, but are not limited to, the L-20, KM-1200, or KM-2000 Ploughshare® type plough mixers, which are commercially available from Lodige USA, Inc, of Ronkonkoma, N.Y., or the parent company of Warburg, Germany. However, the scope of the invention is not limited to just these types of mixers. Other types of mixers may also optionally be used. The isotopes and filler material may be mixed until they are sufficiently homogeneous for the intended implementation. As previously stated, the radioactive isotopes may optionally be initially mixed with a portion of the filler material, and then subsequently mixed with another portion of the filler material. In one or more embodiments of the invention, potassium permanganate, ferro-magnetic particles, a dye, or other chemical indicator may be used or referenced as an indicator of the degree of mixing or homogeneity.

B. Mixing Radioactive Material with Treatment Composition

Then, the radioactive material diluted in the filler material may be contacted and mixed with a radioactive material treatment composition and water, at block 320. In one or more embodiments, shortly prior to use, such as, for example, from several minutes to several hours before use, the radioactive material treatment composition as disclosed elsewhere herein, may be combined with water, to form a thick solid-liquid sludge, "mud", or slurry. The water of the slurry may be saturated or supersaturated with at least some of the salts of the radioactive material treatment composition. Alternatively, water may be added to the filler material.

Then, the solid-liquid mixture may be combined with the radioactive material. In one or more embodiments of the invention, the radioactive material treatment composition and radioactive material may be combined in a volume ratio that ranges from about 1:50 to 1:2, although the scope of the invention is not limited to these particular ratios. In one aspect, the composition added may provide an amount of zeolite that is sufficient to sorb a significant portion or all of the radioactive isotope.

In one or more embodiments of the invention, the mixer may include a plough mixer, although this is not required. Non-limiting examples of suitable plough mixers are the L-20, KM-1200, or KM-2000 Ploughshare® mixers, which are commercially available from Lodige USA, Inc, of Ronkonkoma, N.Y., having the parent company of Warburg, Germany. The Ploughshare® mixers may mix the components by utilizing a mechanically induced fluidized bed reportedly created by shovels that rotate close to inner walls of a drum and thrust the components inside the drum. In one or more embodiments of the invention, such mixers may be operated at from about 50 to 300 revolutions per minute (rpm) to achieve a Froude Number ranging from about 6 to 8, such as from 6 to 7, although this is not required.

In one or more embodiments of the invention, the radioactive material and treatment composition may be mixed under such conditions for a period of time that is less than about 10 minutes, or less than about 7 minutes, such as, for example, from about 2 to 7 minutes. Often, the period of time is from about 3 to 6 minutes, and may be less than 5 minutes.

A potential advantage of using such plough mixers is that they may achieve comparatively good mixing of the contents of the drum in a relatively short period of time, which may tend to be compatible with the treatment processes described herein. The mixing action may also help to avoid separation of the salt crystals from around the zeolites. However, the scope of the invention is not limited to just these types of mixers. Other types of mixers may also optionally be used. For example, Hobart dough mixers have been tested on non-radioactive materials and are believed to be suitable. In one aspect, the mixer may optionally be provided on a mobile platform, such as, for example, a bed of a vehicle, or a trailer, and moved to a remediation site and used there, although this is not required.

In one or more embodiments of the invention, the temperature in the mixer during the mixing process may be controlled to be in the range of about 120 to 180° F., although this is not required. Some of the heat may be provided by exothermic processes and additional heating and/or cooling may also optionally be used.

In one or more embodiments of the invention, the amount of water in the mixer during this stage of mixing may be adjusted or prescribed to be in the range of 10 to 20 wt %, such as, for example, from 22 to 16 wt %. However, the scope of the invention is not limited in this respect. If desired, a deflocculating agent, such as, for example, sodium silicate or cellulose, may optionally be added, and may potentially be used to reduce the water content. If desired, a solvent, such as, for example, methanol, ethanol, or other short-chain alkanols, may optionally be used to replace a portion of the water.

C. Sorbing Radioactive Isotopes with Sorbent

Referring again to FIG. 3, during the mixing period, and potentially shortly thereafter, the zeolites or other sorbents of the treatment composition may sorb at least a portion of the radioactive isotopes, at block 330. The zeolites or other sorbents may provide an environment that may sorb and retain or hold the radioactive isotopes. In one or more embodiments of the invention, the zeolites of the treatment composition may initially be dehydrated or dried so that they may sorb more water or other fluid potentially laden with radioactive isotopes into their pores, although this is not required. In one or more embodiments of the invention, the zeolites may be pre-treated to promote binding or retention of the radioactive isotopes, although this is not required. As one example, a surfactant, such as, for example, hexadecyltrimethylammonium bromide, may be used to treat the zeolite to make the internal cavities of the zeolite affinitive for anions instead of cations. Treated and non-treated zeolites may be used in combination to sorb both cations and anions. As another example, a chlorine compound, such as, for example, a perchlorinate, may be used to create a stationary solvent phase in the cavities to customize sorption for organics potentially laden with radioactive isotopes. As another example, a small molecular or ion trap may be included in the zeolites to further retain radioactive isotopes. As yet another example, sodium hydroxide may be used to open up the internal structure, such as to facilitate sorption of larger molecules or more rapid sorption of molecules or water laden with isotopes.

D. Growing Salt Crystals Around Sorbent

During the mixing period or process, salt of the treatment composition may start to form crystals that may grow in, on, and around, and coat particles, agglomerates, or other portions of the zeolites and filler material, at block 340. Some of the salt materials may react with the surfaces of the filler material and zeolites to provide good contact and adhesion and the salt materials may grow as crystals between the filler material and zeolites. The salts may become occluded into the growing matrix as anion and cation donors. Water having the salts therein may be drawn or sorbed into the pores of the zeolites and thereafter crystals may form in the pores or internal structure to help seal the radioactive isotopes in the zeolites. This may result in an aggregate in which the crystals bound to the filler material and zeolites may form a coating, sheath, or encapsulation layer to help encapsulate the radioactive isotopes within the cavities of the zeolite. This may tend to reduce leaching or removal of the radioactive isotopes from the cavities of the zeolites. In some cases, radioactive isotopes may potentially be incorporated directly in the salt crystals by salt crystal formation reactions or by the salt crystals growing around them, which may further help to contain the radioactive isotopes.

It is presently thought that excessive mixing may potentially tend to reduce the effectiveness of the containment of the radioactive isotopes. Without wishing to be bound by this particular theory, one potential explanation is that the chloride salts and other salts may be over mixed or "emulsified" with the filler, which may tend to hinder crystal growth and/or encapsulation of the radioactive materials within the cavities of the zeolites. Another potential explanation is that excessive mixing may potentially break the salt crystals free of the zeolites.

E. Mixing Cement with Sorbent and Salt Crystal Mixture

Referring again to FIG. 3, after mixing the radioactive materials with the radioactive material treatment composition as described above, the resulting mixture or treated product may optionally be further treated with cement, lime, or one or more other inorganic binding agents. The cement or other inorganic binding agent may be mixed with the aforementioned resulting mixture, at block 350.

In various embodiments of the invention, the cement may be mixed in an amount that is from about 0.5 to 10 wt %, or from about 0.5 to 5 wt %, or from about 1 to 3 wt % of the total volume of radioactive material treated, although the scope of the invention is not so limited. More cement may also optionally be used, although this may tend to increase the cost of treatment. The mixing may coat or otherwise provide the cement or other inorganic binding agent or composition around particles, clumps, or other portions of the zeolite, filler material, and growing and/or grown crystals.

In one or more embodiments of the invention, the inorganic binding agent may be introduced into the same mixer that already contains the mixture previously described. Alternatively, a different mixer may be used. In one aspect, a first mixer to mix in the treatment composition and a second mixer to mix in the lime and/or cement or other binding agent may be connected in series with one another to provide a continuous mixing process, which may potentially help to reduce downtime needed to load and unload mixers.

In one or more embodiments of the invention, the cement and/or lime or other binding agent may be mixed with the treated radioactive material mixture for a period of time ranging from about 30 seconds to 3 minutes, although this is not required. In aspects, the period of time may be less than 2 minutes, or less than 1 minute, although this is not required. It is presently thought that excessive mixing may tend to disrupt the encapsulation or containment of the radioactive materials.

When adding the binding agent, or during the mixing period, the water content in the mixer may optionally be adjusted to a value that is appropriate to promote formation of good hardened monolith or other binding material. For example, in one or more embodiments of the invention, an adjustment amount of water may be added to give final water content is in the range of from about 14 to 18 wt %. If less than 14 wt % is desired a deflocculant such as sodium silicate may optionally be added.

The wet but hardening final product may be provided to a suitable destination. Examples of suitable destinations include, but are not limited to, a hardening mold or process, or to a packaging process.

F. Hardening the Binding Agent Around Sorbent and Salt Crystals

Referring again to FIG. 3, the cement or other binding agent may harden, at block 360. As it hardens, the cement may provide a hard coating, sheath, or encapsulation layer around the particles, clumps, or other portions of the zeolite, filler material, and growing and/or grown crystals, which may further help to reduce leaching or other escape of the radioactive isotopes from the internal structures of the zeolites or other sorbent. The cement or other inorganic binding agent may also contribute solidity, mechanical integrity, and/or strength to the treated isotope material. In some cases, radioactive isotopes may be incorporated directly in the cement potentially by cementitious reactions, which may further help to contain these materials.

If appropriate, compression and/or leaching tests may be performed for quality control or verification. The treated radioactive isotopes may then be stored for prolonged periods of time.

G. Example Optional Variations of the Described Method

Various exemplary radioactive material treatment methods have been described in conjunction with FIG. 3, although the scope of the invention is not limited to just these particular methods. Alternate methods are contemplated in which operations are performed in different order. For example, water may be combined after commencement of mixing of the radioactive material treatment composition and the radioactive material. As another example, water may first be combined with the filler and/or the filler with the radioactive material instead of the treatment composition. Still alternate methods are contemplated in which operations are added to the methods. For example, the unhardened cementitious mixture may be shaped or molded. As another example, analysis of the radioactive material may be performed and a treatment composition may be tailored based on the analysis. Many further modifications and adaptations may be made to the methods and are contemplated.

IV. EXAMPLE RADIOACTIVE MATERIAL TREATMENT COMPOSITIONS

As described above, in one or more embodiments of the invention, a radioactive material, such as, for example, radioactive isotopes diluted in a filler material, may be treated with a radioactive material treatment composition containing salt and sorbent. A radioactive material treatment composition, according to one or more embodiments of the invention, may include in relatively larger proportion or mostly a salt mixture and in relatively smaller proportion one or more sorbents to sorb one or more radioactive isotopes or compounds thereof. As used herein, mostly salt means more than 50% salt. By way of example, in one or more embodiments of the invention, the radioactive material treatment composition may include at least 75 wt % salt, such as, for example, from about 75 to 99.5 wt % salt, and at least 0.5 wt % sorbent, such as, for example, from 0.5 to 25 wt % sorbent, although the scope of the invention is not so limited.

The inventor has considered numerous different possible treatment compositions, including compositions with varying amounts of various different types of salts, and different types of sorbents. This section describes various embodiments of radioactive material treatment compositions that may be used. However, the scope of the invention is not limited to these particular treatment compositions. Many further modifications and variations of these treatment compositions are contemplated and will be apparent to those skilled in the art and having the benefit of the present disclosure.

A suitable salt mixture, according to one or more embodiments of the invention, may optionally include one or more halide salts, such as, for example, one or more chloride salts, together with one or more sulfate salts, although this is not required. The inclusion of both sulfate and halide salts may allow encapsulating the zeolites within a matrix of different crystals formed integrally with one another which may tend to improve encapsulation of the radioactive isotopes. The halide and sulfate salts may crystallize to form different crystal structures that may interlock and thereby help to contain radioactive isotopes within a matrix. The sulfate salts may tend to promote formation of monoclinic crystals or other differently shaped crystals, which may tend to add integrity to the salt crystals and promote good encapsulation. One particular example of a suitable sulfate salt is magnesium sulfate, although others are also suitable. Chloride salts tend to promote good and rapid crystal growth. In one or more embodiments of the invention, the one or more halide salts may optionally include one or more monovalent cation salts, and one or more polyvalent cation salts, although this is not required. Suitable monovalent halide salts include, but are not limited to, sodium chloride, ammonium chloride, potassium chloride, and the like. Suitable polyvalent halide salts include, but are not limited to, calcium chloride, magnesium chloride, magnesium fluoride, and the like. In one aspect, this may create different crystal structures that may add diversity and interlock to aid containment. This may further promote containment of the radioactive isotopes within the confines of a matrix of inter-grown crystals and potentially help to reduce leaching of radioactive isotopes.

One type of suitable sorbent is a zeolite. A zeolite may include a natural or synthetic hydrous silicate or aluminosilicate microporous solid that may have a highly organized or structured open three-dimensional crystal structure of openings and cavities in a lattice. The zeolite may act as a molecular sieve, adsorbent, and/or ion exchanger to selectively sorb radioactive isotopes into the internal structure based, at least in part, on a size exclusion process and/or the chemical environment inside the cavities. Other suitable sorbents include, but are not limited to, chelating agents, and other materials known to have binding or bonding properties with respect to radioactive isotopes. Calcined clays, activated carbons, and like sorbents may also potentially be used in some embodiments depending upon the particular radioactive isotopes and implementation. For example, bentonite, illite and kaolin (all potentially calcined) may potentially be used, depending upon the particular implementation. Bentonite, illite and kaolin are also alumino-silicates. Combinations of different types of sorbents may optionally be included in the composition, such as, for example, to each sorb different types of radioactive isotopes and potentially other hazardous materials included along with the radioactive isotopes. The total sorbent included in the composition may be based, at least in part, on the amount of radioactive isotopes to be sorbed. In various embodiments of the invention, the total sorbent may be less than 15 wt %, less than 10 wt %, less than 5 wt %, and/or more than 0.5 wt %, although this is not required.

Other components may optionally be included in the radioactive material treatment composition. For example, magnesium may optionally be included in order to help react with filler material, or the like to help promote strong and integral attachment of the crystals to the filler, although this is not required. A relatively higher soluble form of magnesium, such as, for example, magnesium oxide, may optionally be included to increase the amount of soluble magnesium when the composition is combined with water.

As another example, the composition may optionally include one or more pH adjustment chemicals, such as, for example, sodium bicarbonate, sodium carbonate, potash, or another base, or a combination of bases, to promote a basic pH, although this is not required. A basic pH, such as, for example, a pH greater than 10, or greater than 11, or greater than 12, may potentially help to avoid build up of hydrogen gas during long-term storage. The high pH may also help to protect against unexpected exposure to acid.

As yet another example, the composition may optionally include one or more anti-corrosion chemicals or salts, such as, for example, aluminum chloride, although this is not required. The aluminum chloride may help to reduce corrosion of steel and certain other metals. Aluminum chloride may be included in various proportions in the composition depending upon whether or not the potential for corrosion is of concern.

As a still further example, an indicator chemical or material may optionally be included in the composition to provide an aid for visually or otherwise assessing the degree of mixing of the mixture or the homogeneity, although this is not required. This may help to ensure criticality standards are met or exceeded. Suitable indictor chemicals or materials include, but are not limited to, potassium permanganate, dyes, ferro-magnetic particles, or other materials whose relative concentration in the mixture may readily be assessed. These are just a few examples.

V. SPECIFIC EXAMPLES OF SUITABLE RADIOACTIVE MATERIAL TREATMENT COMPOSITIONS

An example of a suitable radioactive material treatment composition, according to one or more embodiments of the invention, is disclosed in Table 1. Components and concentrations are listed.

TABLE 1

| Component | Concentration (wt %) |
|---|---|
| Salt | 75-99.5% |
| Sorbent | 0.05-25% |

Another example of a suitable radioactive material treatment composition, according to one or more embodiments of the invention, is disclosed in Table 2. Components and concentrations are listed.

TABLE 2

| Component | Concentration (wt %) |
|---|---|
| Monovalent Halide Salt | Remainder |
| Polyvalent Halide Salt | 0-35% |
| Sulfate Salt | 0-5% |
| Anti-Corrosion Agent | 0-5% |
| Magnesium Oxide | 0-5% |
| Base | Sufficient to give pH > 10 |
| Sorbent | 0.5-25% |

In various embodiments of the invention, from all to a small amount of one or more, or various combinations, of the polyvalent halide salt, the sulfate salt, the anti-corrosion agent, and magnesium oxide, may optionally be omitted from the composition. The remaining percentage or bulk of the mixture may be made up of a monovalent halide salt, such as, for example, sodium chloride, which is widely available and relatively inexpensive.

Yet another example of a suitable radioactive material treatment composition, according to one or more embodiments of the invention, is disclosed in Table 3. Components, concentrations, and optional particle sizes are listed.

TABLE 3

| Component | Concentration (wt %) | Particle Size |
|---|---|---|
| Sodium Chloride | Remainder | 0-1 mm |
| Ammonium Chloride | 0-2% or about 1% | 0-1 mm |
| Aluminum Chloride | 0-5% or about 3% | 0-1 mm |
| Potassium Chloride | 0-20% or about 15% | 0-1 mm or flocks |
| Calcium Chloride | 0-20% or about 15% | 0-5 mm |
| Magnesium Chloride | 0-20% or about 15% | fine grain or 50 mesh |
| Magnesium Oxide | 0-4% or about 2% | −200 mesh |
| Magnesium Sulfate | 0-4% or about 3% | 0-1 mm |
| Sodium Carbonate | 0-4% or about 3% | 0-1 mm |
| Zeolite (ASM A4) | 1-10% or about 2-6% | −325 mesh |
| Potassium Permanganate | 0-2% or about 0-1% | 0-1 mm |

In various embodiments of the invention, from all to a small amount of one or more, or various combinations, of ammonium chloride, aluminum chloride, potassium chloride, calcium chloride, magnesium chloride, magnesium oxide, magnesium sulfate, sodium bicarbonate, and potassium permanganate, may optionally be omitted from the composition. The remaining percentage or bulk of the mixture may be made up of another component, such as, for example, sodium chloride.

A still further example of a suitable radioactive material treatment composition, according to one or more embodiments of the invention, is disclosed in Table 4. Components, concentrations, and optional particle sizes are listed. In this composition, the term "about" means±50% of the indicated amount for indicated amounts that are less than 5% and ±20% of the indicated amount for indicated amounts that are over 5%. In this composition, the remaining percentage or bulk of the mixture may be made up of sodium chloride. Sodium chloride may be present in the highest concentration.

TABLE 4

| Component | Concentration (wt %) | Particle Size |
|---|---|---|
| Sodium Chloride | about 35% | 0-1 mm |
| Ammonium Chloride | about 1% | 0-1 mm |
| Aluminum Chloride | about 3% | 0-1 mm |
| Potassium Chloride | about 15% | 0-1 mm or flocks |
| Calcium Chloride | about 15% | 0-5 mm |
| Magnesium Chloride | about 15% | fine grain or 50 mesh |
| Magnesium Oxide | about 2% | −200 mesh |
| Magnesium Sulfate | about 3% | 0-1 mm |
| Sodium Carbonate | about 3% | 0-1 mm |
| Zeolite (ASM A4) | about 1-5% | −325 mesh |
| Potassium Permanganate | about 0-1% | 0-1 mm |

Many other variations of the compositions included in Tables 1-4 are contemplated and will be apparent to those skilled in the art and having the benefit of the present disclosure. For example, compositions are contemplated that include additional components, omit one or more of the listed components, and/or have the components in different proportions. The scope of the invention is not limited to any known composition.

Compositions like those shown above, or variations of these compositions, may include solid particulate materials or powders that may be mixed or otherwise combined together in the indicated proportions. The resulting mixtures may optionally be sealed in a container or otherwise packaged and optionally stored until an intended time of use.

VI. OPTIONALLY TAILORING RADIOACTIVE MATERIAL TREATMENT COMPOSITIONS TO PARTICULAR RADIOACTIVE MATERIALS

The radioactive material treatment compositions disclosed above are suitable for treating a wide variety of radioactive materials. However, in one or more embodiments of the invention, a radioactive material treatment composition may optionally be altered and/or tailored for a particular radioactive material based, at least in part, on analysis of the radioactive material. Initially, a radioactive material sample may be collected and analyzed. By way of example, the radioactive material may be analyzed for water content, organic content, radioactive material type, radioactive material content, or hazardous materials included in the radioactive material, electrical conductivity, compressive strength, pH, salt content, and optionally other parameters. The radioactive material treatment composition may be formed or modified based at least in part on the analysis. By way of example, the type of zeolite or other sorbent may be determined based on the type of radioactive and other potential hazardous materials, the amount of zeolite or other sorbent may be determined based on the amount of radioactive and potentially other existing hazardous materials, the amount of water needed for addition to the radioactive material treatment composition may be determined based on the amount of water in the radioactive material. Such adaptations may potentially improve treatment, but are not required. Leaching tests may also optionally be formed on treated samples prior to large-scale remediation treatment. However, such tailoring of the treatment composition is optional and not required. Pre-packaged general-purpose treatment compositions may also optionally be used.

VII. EXAMPLES

Having been generally described, the following examples are given as particular embodiments of the invention, to illustrate some of the properties and demonstrate the practical advantages thereof, and to allow one skilled in the art to utilize the invention. It is understood that these examples are to be construed as merely illustrative.

Example 1

Experiments have been performed to demonstrate the significant increase in compressive strength of a surrogate steam reformed waste product diluted in a filler material and treated as disclosed herein. 2 volumes of the surrogate steam reformed waste product were diluted in 9.2 volumes of filler material. The particular filler material included about 4% microcrystalline silicon, about 23% powdered flint, about 22% fine sand, about 11% coarse calcined clay having average diameter of 3-4 millimeters, and about 40% calcined bentonite (where the percents are expressed in v/v %). This diluted material was treated with about 0.2 volumes of a radioactive material treatment composition similar to that shown in Table 4. The resulting material was treated with about 1.1 volumes of Portland cement as binding agent. Compressive strength was monitored over several weeks using ASTM C-39. The results are presented in Table 5.

TABLE 5

| Hardening Time | COMPRESSIVE STRENGTH (PSI) |
|---|---|
| Less than two weeks | Less than 500 |
| At least three weeks | Greater than 500 |
| Several Months | Approaching 1000 or greater |

These results indicate that the compressive strength tends to increase over time. After about three weeks, the compressive strength is greater than 500 psi and still increasing with time. After several months, it is expected that the compressive strength may approach or even exceed 1000 psi.

Example 2

This example demonstrates the effectiveness of treating various soils contaminated with heavy metals with treatment compositions and methods as disclosed herein. The samples were treated using compositions similar to those disclosed in Table 4 using methods similar to those disclosed herein. Leaching was assessed by method EPA 1311. Results are listed in Table 6.

TABLE 6

| DESCRIPTION OF SAMPLE | Contaminant | LEACHING BEFORE TREATMENT | LEACHING AFTER TREATMENT | HARDNESS (COMPRESSIVE STRENGTH) AFTER TREATMENT |
|---|---|---|---|---|
| Tar clay soil | Antimony | 42.5 ug/g | 0.09 ug/l | 1.8 MPa |
| | Arsenic | 115 ug/g | 0.03 ug/l | |
| | Lead | 625 ug/g | Non Detectable | |
| | Mod. TPH | 130000 | Non Detectable | |
| Alkaline clay soil | Benzene | 0.072 mg/l | 0.021 mg/l | 1.65 MPa |
| | Toluene | 0.142 | 0.030 | |
| | Xylene | 0.009 | <0.002 | |
| | Ethylbenzene | 0.088 | 0.018 | |

Method: EPA 1311

As shown the leaching after the treatment was in all cases reduced compared to leaching before treatment. Also, significant increase in compressive strength is obtained after treatment. Similar reductions in leaching and increases in compressive strength may also be observed and are also expected when treating radioactive isotopes diluted in filler.

VIII. OTHER MATTERS

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

In the description above, for the purposes of explanation, numerous specific details have been set forth in order to provide a thorough understanding of the embodiments of the invention. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description.

It will also be appreciated, by one skilled in the art, that modifications may be made to the embodiments disclosed herein, such as, for example, to the sizes, configurations, functions, materials, and manner of operation of the components of the embodiments. All equivalent relationships to those illustrated in the drawings and described in the specification are encompassed within embodiments of the invention.

Various operations and methods have been described. Some of the methods have been described in a basic form, but operations may optionally be added to and/or removed from the methods. The operations of the methods may also often optionally be performed in different order. Many modifications and adaptations may be made to the methods and are contemplated.

For clarity, in the claims, any element that does not explicitly state "means for" performing a specified function, or "step for" performing a specified function, is not to be interpreted as a "means" or "step" clause as specified in 35 U.S.C. Section 112, Paragraph 6. In particular, any potential use of "step of" in the claims herein is not intended to invoke the provisions of 35 U.S.C. Section 112, Paragraph 6.

It should also be appreciated that reference throughout this specification to "one embodiment", "an embodiment", or "one or more embodiments", for example, means that a particular feature may be included in the practice of the invention. Similarly, it should be appreciated that in the description various features are sometimes grouped together in a single embodiment, Figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

Accordingly, while the invention has been thoroughly described in terms of several embodiments, those skilled in the art will recognize that the invention is not limited to the particular embodiments described, but may be practiced with modification and alteration within the spirit and scope of the appended claims. The description is thus to be regarded as illustrative instead of limiting.

What is claimed is:

1. A method comprising:

diluting a radioactive isotope in a filler material;

mixing the radioactive isotope diluted in the filler material with a radioactive material treatment composition for at least two minutes to form a resulting mixture, the radioactive material treatment composition including mostly salt, and from 0.5 to 15 wt % sorbent, wherein the sorbent comprises a zeolite;

during said mixing, sorbing the radioactive isotope with the sorbent;

during said mixing, crystallizing the salt to form a matrix of growing salt crystals around the sorbent that comprises the zeolite and the filler, wherein the matrix of salt crystals formed around the sorbent help to encapsulate the radioactive isotope that has been sorbed by the sorbent;

after said mixing the radioactive isotope diluted in the filler material with the radioactive material treatment composition, mixing an inorganic binding agent with the resulting mixture for a period of time with a mixer;

hardening the inorganic binding agent around the crystallized salt and around the sorbent.

2. The method of claim 1, wherein said diluting comprises:

diluting the radioactive isotope in a first portion of the filler material; and diluting the first portion having the radioactive isotope in a second portion of the filler material, wherein the first portion has one or more selected from a different material and a different average particle size, than the second portion.

3. The method of claim 1, further comprising preparing the filler material including mixing particles of different materials that are capable of participating in interfacial binding reactions with one another.

4. The method of claim 1, wherein said diluting comprises:

mixing an indicator chemical with the filler material and the radioactive isotope; and assessing homogeneity of mixing using the indicator chemical.

5. The method of claim 1, further comprising, prior to said sorbing, discarding particles of the filler material that pass through a 100 or smaller mesh.

6. The method of claim 1, further comprising preparing the filler material including adjusting a particle size distribution of the filler material to achieve a fineness modulus in a predetermined range.

7. The method of claim 1, wherein said mixing the radioactive isotope diluted in the filler material with the radioactive material treatment composition comprises mixing for less than 10 minutes using a plough mixer operating at a Froude number ranging from 6 to 8.

8. The method of claim 1, wherein the radioactive material treatment composition comprises at least 75 wt % salt including halide salt and sulfate salt, and wherein said crystallizing the salt comprises forming intergrown and interlocking halide salt crystals and sulfate salt crystals around the sorbent.

9. The method of claim 1, wherein the radioactive material treatment composition comprises at least 75 wt % salt including monovalent cation halide salt and polyvalent cation halide salt, and wherein said crystallizing the salt comprises forming intergrown and interlocking monovalent cation halide salt crystals and polyvalent cation halide salt crystals around the sorbent.

10. A method comprising:

mixing a radioactive isotope diluted in a filler material with a radioactive material treatment composition to form a resulting material, the radioactive material treatment composition including mostly salt, and from 0.5 to 15 wt % sorbent, wherein most of the salt comprises one or more selected from sodium chloride, potassium chloride, calcium chloride, and magnesium chloride;

mixing the resulting material with one or more inorganic binding agents;

diluting the radioactive isotope in a first portion of the filler material; and diluting the first portion having the radioactive isotope in a second portion of the filler material, wherein the first portion has one or more selected from a different material and a different average particle size, than the second portion.

11. A method comprising:

preparing a filler material including mixing particles of different materials that are capable of participating in interfacial binding reactions with one another;

mixing a radioactive isotope diluted in the filler material with a radioactive material treatment composition to form a resulting material, the radioactive material treatment composition including mostly salt, and from 0.5 to 15 wt % sorbent, wherein most of the salt comprises one or more selected from sodium chloride, potassium chloride, calcium chloride, and magnesium chloride; and mixing the resulting material with one or more inorganic binding agents.

12. A method comprising:

mixing a radioactive isotope diluted in a filler material with a radioactive material treatment composition to form a resulting material the radioactive material treatment composition including mostly salt, and from 0.5 to 15 wt % sorbent, wherein most of the salt comprises one or more selected from sodium chloride, potassium chloride, calcium chloride, and magnesium chloride;

mixing the resulting material with one or more inorganic binding agents;

prior to said mixing the radioactive isotope diluted in the filler material with the radioactive material treatment composition, mixing the radioactive isotope, the filler material, and an indicator chemical; and assessing homogeneity of mixing using the indicator chemical.

13. A method comprising:

mixing a radioactive isotope diluted in a filler material with a radioactive material treatment composition to form a resulting material, the radioactive material treatment composition including mostly salt, and from 0.5 to 15 wt % sorbent, wherein most of the salt comprises one or more selected from sodium chloride, potassium chloride, calcium chloride, and magnesium chloride;

mixing the resulting material with one or more inorganic binding agents; and discarding particles of the filler material that pass through a 100 or smaller mesh.

14. A method comprising:

preparing a filler material including adjusting a particle size distribution of the filler material to achieve a fineness modulus in a predetermined range;

mixing a radioactive isotope diluted in the filler material with a radioactive material treatment composition to form a resulting material, the radioactive material treatment composition including mostly salt, and from 0.5 to 15 wt % sorbent, wherein most of the salt comprises one or more selected from sodium chloride, potassium chloride, calcium chloride, and magnesium chloride; and mixing the resulting material with one or more inorganic binding agents.

15. A method comprising:

mixing a radioactive isotope diluted in a filler material with a radioactive material treatment composition to form a resulting material, the radioactive material treatment composition including mostly salt, and from 0.5 to 15 wt % sorbent, wherein most of the salt comprises one or more selected from sodium chloride, potassium chloride, calcium chloride, and magnesium chloride, wherein said mixing the radioactive isotope diluted in the filler material with the radioactive material treatment composition comprises mixing for less than 10 minutes using a plough mixer operating at a Froude number ranging from 6 to 8; and mixing the resulting material with one or more inorganic binding agents.

16. A method comprising:

mixing a radioactive isotope diluted in a filler material with a radioactive material treatment composition to form a resulting material, the radioactive material treatment composition including mostly salt, and from 0.5 to 15 wt % sorbent, wherein most of the salt comprises one or more selected from sodium chloride, potassium chloride, calcium chloride, and magnesium chloride;

mixing the resulting material with one or more inorganic binding agents; and crystallizing the salt to form a matrix of growing salt crystals around the sorbent and the filler.

* * * * *